United States Patent [19]

Vecchia

[11] Patent Number: 4,858,448

[45] Date of Patent: Aug. 22, 1989

[54] APPARATUS FOR THE CONTINUOUS DECATING OF A FABRIC

[75] Inventor: Gino D. Vecchia, Santorso, Italy

[73] Assignee: Sperotto Rimar S.P.A., Thiene, Italy

[21] Appl. No.: 190,994

[22] Filed: May 6, 1988

[30] Foreign Application Priority Data

May 26, 1987 [IT] Italy ..... 20677 A/87

[51] Int. Cl.[4] ..... D06B 5/08

[52] U.S. Cl. ..... 68/5 E; 34/123

[58] Field of Search ..... 8/149.3; 68/5 R, 5 B, 68/5 D, 5 E, 8; 34/111, 116, 123

[56] References Cited

U.S. PATENT DOCUMENTS 2,494,807 1/1950 Haeberlin ..... 68/5 B
2,494,808 1/1950 Haeberlin ..... 68/8 X
3,046,771 7/1962 Bailey ..... 68/5 R
3,943,735 3/1976 Riedel ..... 68/5 R

FOREIGN PATENT DOCUMENTS 2622897 12/1977 Fed. Rep. of Germany ..... 68/5 R
616071 1/1949 United Kingdom ..... 68/5 B

*Primary Examiner*—Philip R. Coe
*Attorney, Agent, or Firm*—Roberts, Spiecens & Cohen

[57] ABSTRACT

Apparatus for the continuous decating of a fabric continuously fed to an area provided with a pressurized-steam atmosphere, wherein the area is tightly sealed from the external environment, and the fabric under treatment is maintained in the area between at least one back gray and a cylindrical drum coated with a textile material.

13 Claims, 5 Drawing Sheets

APPARATUS FOR THE CONTINUOUS DECATING OF A FABRIC

FIELD OF THE INVENTION

The present invention relates to apparatus for the continuous decating of a fabric.

Background machines for autoclave-decating operating in alternate-cycle, or batchwise, mode, of the type known from the prior art, perform working cycles essentially constituted by the following main steps:

winding of the fabric, and of the back gray, on a beam;

charging of the beam into an autoclave;

autoclave decating;

removal of the beam from the autoclave;

unwinding of the fabric and of the back gray from the beam.

The winding and unwinding steps take place at suitable stations outside the autoclave. The charging and removal steps require suitable beam-handling units, which considerably contribute to the total cost of the facility and, furthermore, involve an operating time which decreases the production rate.

On the other hand, alternate-cycle, or batchwise, autoclave-decating machines are known, wherein the steps of fabric and back gray winding and unwinding take place with the beam being permanently housed inside the autoclave, so as not to require any operations of beam charging to, and removal from, the autoclave, and the fabric and the back gray can be directly fed from the external station to the beam housed inside the autoclave, and, after the decating step is finished, can be discharged as well from the beam housed inside the autoclave to the external station.

Furthermore, from the view point of quality, the batchwise decating in an autoclave, as a consequence of the treatment of various layers of fabric wound around a beam causes not negligible problems of uniformity in lent effects between the internal and the external layers of the roll, and between the center and the selvedges of the fabric. Such a drawback is indeed the problem all manufacturers of decating machines have been unsuccessfully coping with for many years, and is the cause of complaints by the users of such facilities.

Moreover, the batchwisedecating in an autoclave generally requires an operation of preparation of the fabric to be treated, consisting in a pressing, which is carried out on calendering machines. The purpose of such a preparation is to reduce the thickness of the fabric, in order to prevent such a reduction in thickness from subsequently taking place to an excessive extent during the decating operation in the autoclave, during which the fabric—due to the fact that many layers thereof are wound on a beam—may undergo irreversible deformations.

SUMMARY OF THE INVENTION

An object of the present invention is to provide apparatus for carrying out a continuous decating process, by which it is possible to obtain at least the same qualitative results that are presently only achievable by means of the batchwise treatments in an autoclave, with the negative aspects of these latter being overcome.

A further object is to make it possible for such a process to be performed in continuous mode, with a simply-structured and simply-operating machine.

These, and still further objects according to the invention are achieved by providing apparatus for the continuous decating of a fabric which is fed to, held by and maintained within a couple of back grays, characterized in that in at least a portion of the path along which said fabric runs, there is provided an area with an atmosphere of steam under controllable pressure.

More particularly, according to the invention, the equipment for the continuous decating of a fabric comprises a cylindrical drum, the outer surface of which is constituted by an elastic, deformable material at least partially coated with a first, inner back gray of a textile material, above which said continuous fabric is fed, said cylindrical drum and said first, inner back gray being externally at least partially covered and surrounded by a second, outer back gray of a textile material which is arranged as a continuous, closed loop, and is provided with its own drive means, characterized in that in correspondence with at least a portion wherein said second, outer back gray keeps said fabric in contact with said first, inner back gray and said cylindrical drum, a chamber is positioned, which contains an atmosphere of pressurized steam, said chamber being positioned through at least the whole width of the fabric, and being equipped with pressure-tight sealing elements peripherally disposed relative to said at least one portion.

Preferably, said first, inner back gray coating said elastic, deformable material, is a sleeve.

BRIEF DESCRIPTION OF THE FIGURES OF THE DRAWING

Characteristics and advantages of the equipment for the continuous decating according to the present invention can be better understood from the following exemplifying and non-limitative disclosure also referred to the hereto attached schematic drawings wherein.

DETAILED DESCRIPTION OF PREFERRED EMBODIMENTS

The continuous decating of a fabric according to the invention comprises the continuous feeding of the fabric within a pair of back grays, and is characterized in that in a portion of the path along which said fabric runs, an area is created which contains an atmosphere of steam under a controllable pressure.

Preferably, said area containing said atmosphere of pressurized steam is defined by prearranging steam-tight sealing elements peripherally relative to said area.

According to the invention, a change in the pressure of said steam atmosphere is furthermore possible by adjusting the action of said peripheral tight-sealing elements.

Figure 1:
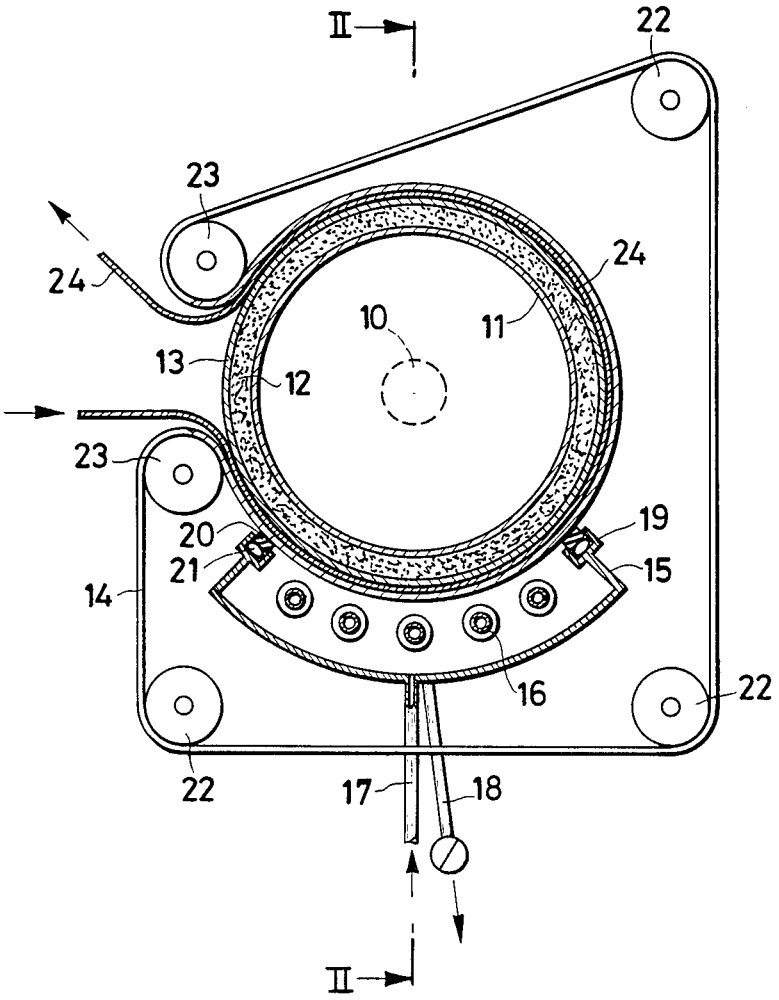
FIG. 1 is a cross section of equipment according to the present invention, taken along line I—I in FIG. 2.
Figure 2:
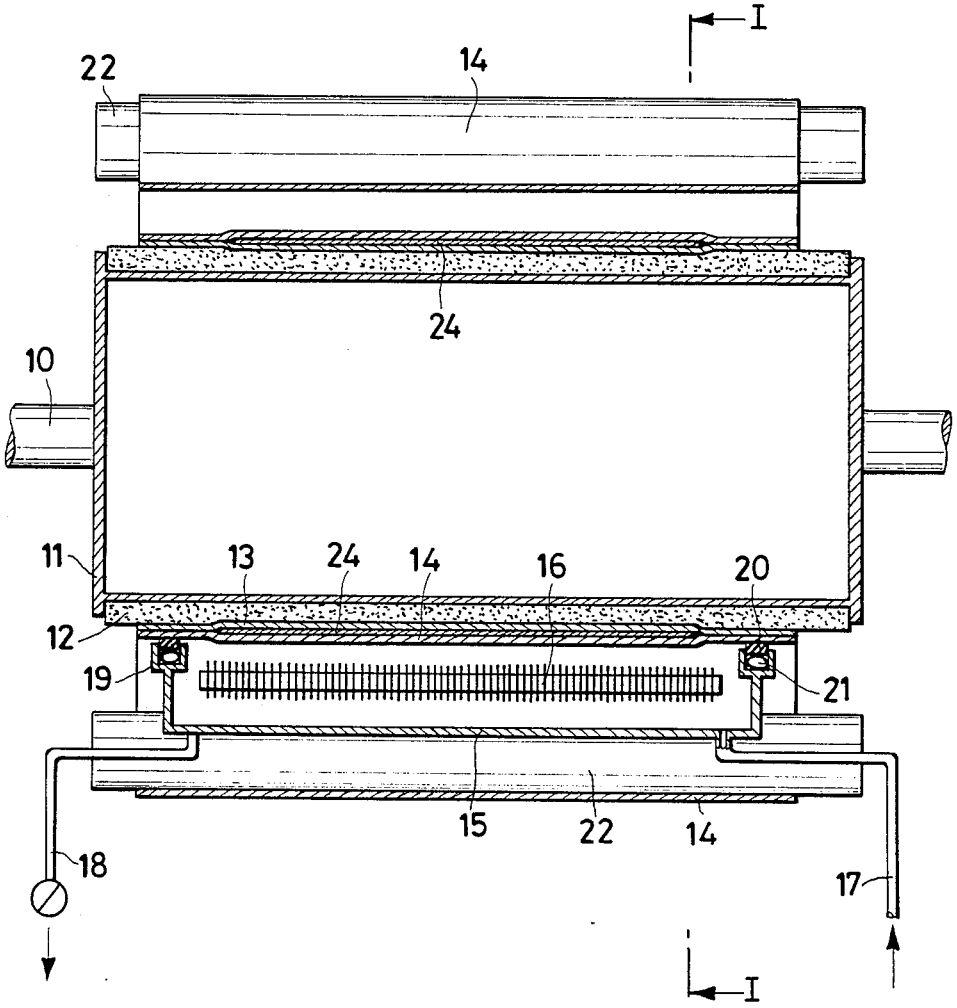
FIG. 2 is a longitudinal sectional view taken along line II—II of FIG. 1.

The invention, as above defined, is practiced by means of equipment which is shown in FIGS. 1 and 2. The equipment is essentially constituted by a cylindrical drum 11, the outer surface 12 of which is constituted by an elastic, deformable material, coated by a sleeve 13 of a textile material, above, and around, which, a back gray 14, also of a textile material, of the closed, continuous-loop type, is wound.

The drum 11, e.g., horizontally positioned, is rotatably supported by means of two axial hubs, fastened to both of the base ends thereof, and only partially shown at 10, on a support framework (not shown). In correspondence with at least a portion of the unit constituted by said drum 11, sleeve 13 and back gray 14, a steaming chamber, or steaming vat 15 is positioned, and maintained in contact therewith and is laterally fasened to the support framework, not shown. Inside chamber 15, a superheating coil is housed, which is constituted by a set of finned pipes 16 through which steam flows, and furthermore a steam feed pipe 17 by which steam under controllable pressure is delivered, and a condensate-drain pipe 18 are provided, the chamber 15 being open at its side opposite said back gray 14.

Said steaming vat 15 has, at its end wall adjacent to said back gray 14, a peripheral groove 19 inside which a tight-sealing element 20 is housed, which has the form of a surface-contact rubbing block, and is pressed against said back gray 14 both transversely and longitudinally relative to said cylindrical drum 11. The pressure of said rubbing block 20 on said back gray 14 is determined and controlled by means of an inflatable element constituted by an air tube 21, interposed between said rubbing block 20 and said groove 19.

The back gray 14 is returned and guided, in the portion of its path wherein it is not wound around the drum 11, on a set of return rolls 22, at least one of which is equipped with a pneumatic or hydraulic device, not shown, known in the prior art, by means of which the tension of the back gray 14 is adjusted, so that this latter can transmit, along the portion of its path wherein it is wound around said cylindrical drum 11, a variable squeezing pressure. Two further motor-driven rolls 23 constitute the drive means by which the back gray 14 is driven and in its turn transmits drive motion to the cylindrical drum 11.

Figure 3:
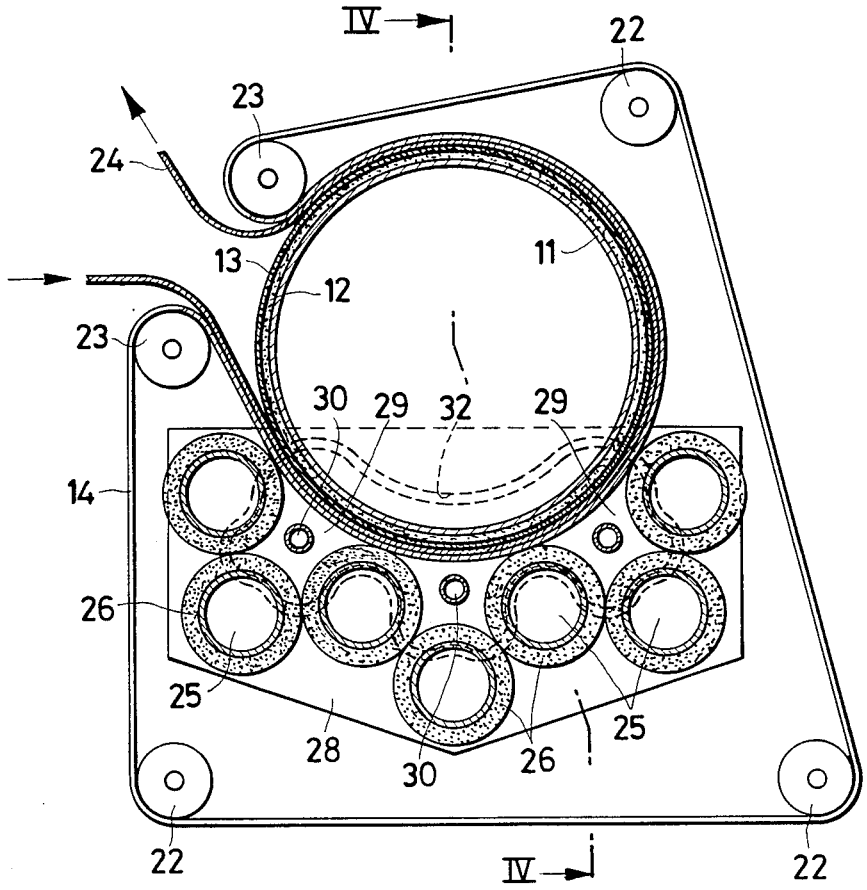
FIG. 3 is a cross section of another embodiment of the equipment of the present invention, taken along line III—III in FIG. 4.
Figure 4:
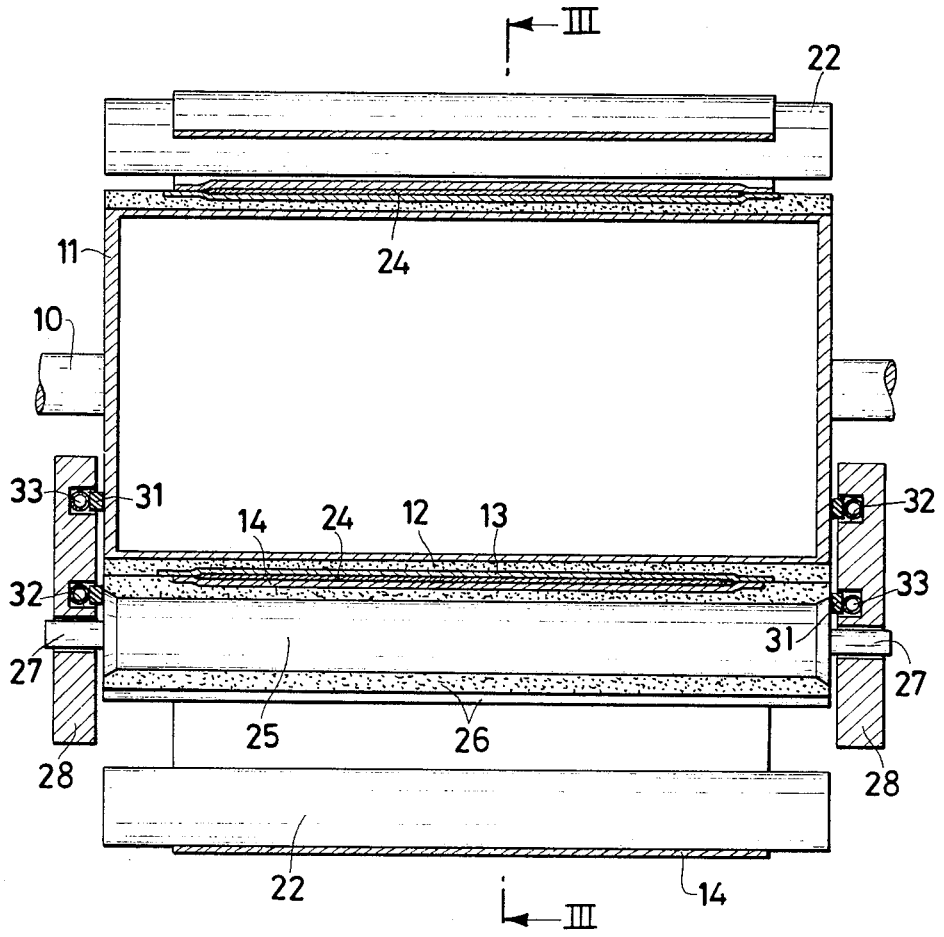
FIG. 4 is a longitudinal cross section taken along line IV—IV in FIG. 3.

According to a further practical embodiment, referring to FIGS. 3 and 4, in correspondence with at least a portion of the unit constituted by said drum 11, sleeve 13 and back gray 14, a set of rolls 25 are positioned, each of said rolls 25 being covered by a sleeve 26 of an elastic, deformable material, and being rotatably supported, by hubs 27, by side support plates 28; said rolls are steam-heated.

The rolls 25 are positioned into contact with one another, and each second roll is kept in contact with the unit constituted by drum 11, sleeve 13 and back gray 14 in such a way as to define, as a whole, at least a steaming chamber 29, inside which at least one steam supply pipe 30 delivering steam under a controllable pressure is installed. Each of said rolls 25 is furthermore equipped with either a pneumatic or hydraulic device, known in the prior art, for keeping the rolls compressed against one another, and against back gray 14.

The pressure applied by rollers 25 to one another, and to back gray 14 performs the function of longitudinal tight sealing against any escape of the steam delivered by each steam supply pipe 30 housed inside each one of said steaming chambers 29.

The side sealing is obtained by means of two gaskets 31 of surface-contact rubbing type, each of which is inserted inside a groove 32 provided on each of said side support plates 28.

The gaskets 31 are furthermore kept pressed against the ends said roll 25 and of drum 11 by two inflatable air tubes 33, each of which is interposed between gasket 31 and groove 32.

The operation of such equipment is as follows: the fabric 24 is continuously fed by the first drive roll 23 and, supported by the back gray 14, enters the space between the sleeve 13 on drum 11 and the back gray 14 wound around it. While being so positioned, the fabric 24 is guided to run along the portion of the circumference of cylindrical drum 11, up to the outlet, which coincides with the second drive roll 23.

The adjustment of the tension of the back gray 14, e.g. carried out as above stated, makes possible a predetermined squeezing pressure of the back gray 14 on the fabric 24, interposed between back gray and the sleeve 13. The thickness of the fabric 24 is compensated by the deformation and the squeezing of the elastic, deformable material 12.

The pressure applied by the rubbing block 20 (FIGS. 1 and 2), or, respectively, the rolls 25 (FIGS. 3 and 4) against the back gray 14 makes possible a squeezing to be caused, which at least limits the escape of the steam respectively fed to the steaming vat 15 by the pipe 17 (FIGS. 1 and 2), or to the steaming chambers 29 by the steam supply pipes 30 (FIGS. 3 and 4).

The steam pressure inside the vat 15 or the chambers 29 is partially determined by the pressure respectively applied by the rubbing block 20 or by the rolls 25 to the back gray 14, and partially by the characteristics of permeability of the textile material of which the back gray 14 and the sleeve 13 are made, wherein each of these could be generally considered a "back-gray".

In fact, pressurized steam respectively delivered by the vat 15 and the chambers 29 through their open walls opposite the drum 11 must be capable of relatively easily flowing through the back gray 14, in order to reach the fabric 24, and the underlying sleeve 13.

As a practical matter, a certain, limited, amount of steam must be capable of flowing, by capillarity, partially through the back gray 14, partially through the fabric 24 and partially through the sleeve 13, in order to purge any air conveyed by said elements as they respectively enter the vat 15 or the chambers 29.

Figure 5:
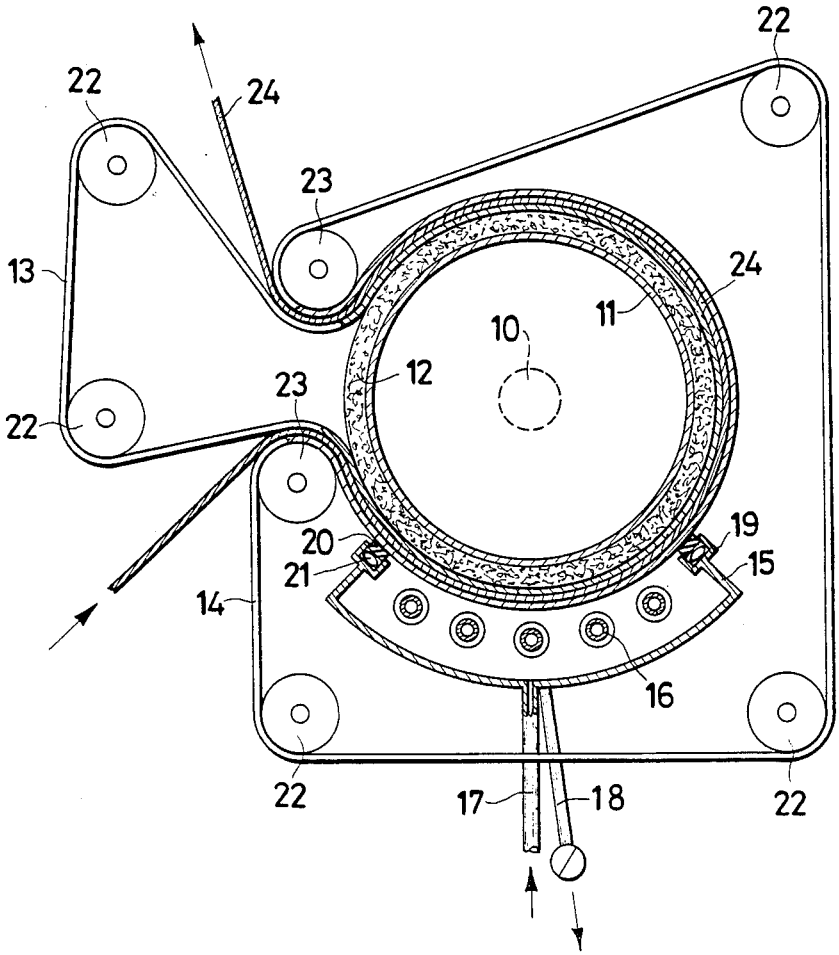
FIG. 5 is a cross-section of still a further embodiment of the equipment of the invention, similar to that in FIG. 1.

As noted above, the sleeve 13 can be considered to be a "back gray", and, for a better understanding thereof, an exemplifying practical embodiment thereof can be seen in FIG. 5, wherein the same parts of the equipment are given the same reference numerals.

In this case, the sleeve 13 is given the shape of a continuous, closed loop partially guided along the elastic, deformable material 12 of the cylindrical drum 11, and partially on return rolls 22, also provided with a tension adjustment device (not shown in the figure).

It thus is clear how the sleeve can be generally regarded as a first, inner back gray 13, at least partially surrounding the external surface, constituted by an elastic, deformable material 12, of the cylindrical drum 11.

In this case, the back gray 14 will be defined as a second, outer back gray 14.

The advantages of a continuous, under-pressure decating process according to the invention can be summarized as follows:

uniformity of treatment in both the longitudinal and the transverse directions of the fabric;

the fabric is no longer undergoing the decating treatment while being wound as a number of layers, and the faults due to permanent deformations are eliminated;

the operations of preparation of the fabric to be subjected to decating are obviated; and the dead times are eliminated, with the production rate being increased, and the operating costs being decreased.

What is claimed is:

1. Equipment for the continuous decating of a fabric comprising a cylindrical drum having an outer surface constituted by an elastic, deformable material, a first, inner back gray of a textile material at least partially covering said outer surface of said drum, the fabric to be decated being continuously fed on said first back gray, a second, outer back gray of a textile material of continuous, closed loop form at least partially surrounding said first back gray and the fabric fed thereon, drive means for said second back gray, a pressurized steam chamber in correspondence with at least one portion of the second back gray which surrounds the first back gray and said cylindrical drum, said chamber extending transversely over at least the entire width of the fabric, and pressure-tight sealing means on said chamber in peripheral contact with said second back gray at said at least one portion thereof.

2. Equipment according to claim 1, wherein said first back gray coprises a sleeve.

3. Equipment according to claim 2 wherein said sleeve partially covers the periphery of said drum and in part is spaced from said drum.

4. Equipment according to claim 3 wherein said sleeve forms an endless loop a portion of which partially covers the periphery of said drum.

5. Equipment according to claim 1, wherein said chamber includes a steam feed pipe delivering pressurized steam, and a condensate drain pipe.

6. Equipment according to claim 1, comprising inside said chamber, a superheating coil, through which steam flows.

7. Equipment according to claim 1, wherein said sealing means comprise surface-contact rubbing elements, positioned longitudinally of said cylindrical drum, and transversely surrounding said cylindrical drum.

8. Equipment according to claim 1, wherein said sealing means comprises rubbing-block elements, each associated with at least one inflatable element.

9. Equipment according to claim 1, wherein said chamber includes a set of revolving rolls in contact with one another, with each second roll in contact with said second back gray.

10. Equipment according to claim 9, comprising inside said chamber at least one steam feed pipe delivering pressurized steam.

11. Equipment according to claim 9, comprising an elastic, deformable material on said revolving rolls and means for internally heating the rolls with steam.

12. Equipment according to claim 9, wherein said set of revolving rolls constitute a steam pressure sealing element extending longitudinally relative to said cylindrical drum.

13. Equipment according to claim 9, comprising between said set of revolving rolls and said cylindrical drum lateral tight-sealing elements of surface-contact rubbing type.

* * * * *